US006015372A

United States Patent [19]

Steffee et al.

[11] Patent Number: 6,015,372

[45] Date of Patent: Jan. 18, 2000

[54] ABDOMINAL EXERCISE MACHINE AND METHODS

[75] Inventors: Clay J Steffee, Anthony; Larry D Berry, Orange Springs; Russell W Kershaw, Silver Springs, all of Fla.

[73] Assignee: MedX 96, Inc., Ocala, Fla.

[21] Appl. No.: 09/033,603

[22] Filed: Mar. 3, 1998

[51] Int. Cl.[7] ..... A63B 23/02

[52] U.S. Cl. ..... 482/137; 452/97; 452/100; 452/121; 452/134; 452/139; 452/140

[58] Field of Search ..... 482/94, 97, 100, 482/121, 129, 130, 134, 136, 137, 139, 140, 142, 907

[56] References Cited

U.S. PATENT DOCUMENTS

| | | | |
|---|---|---|---|
| 4,207,879 | 6/1980 | Safadago et al. | 482/907 |
| 4,349,193 | 9/1982 | Lambert et al. | 482/99 |
| 4,349,194 | 9/1982 | Lambert et al. | 482/100 |
| 4,836,536 | 6/1989 | Jones | 482/100 |
| 5,026,049 | 6/1991 | Goodman | 482/907 |
| 5,094,449 | 3/1992 | Stearns | 482/140 |
| 5,409,438 | 4/1995 | Jones et al. | 482/100 |
| 5,599,261 | 2/1997 | Easley et al. | 482/130 |

*Primary Examiner*—John Mulcahy
*Attorney, Agent, or Firm*—William E. Mouzavires

[57] ABSTRACT

A method and apparatus for exercising the abdominal muscles where the exerciser is seated and the legs are spread apart and held in that position during the exercise which is accomplished by bending the upper torso forwardly and rearwardly through exertion of the abdominal muscles against a resistance offered by a weight stack. The machine includes a movement arm having a resistance pad engageable by the chest of the exerciser as the exerciser moves forwardly to perform positive work and rearwardly to perform negative work. The movement arm includes two parts one of which includes the resistance pad and is mounted to the other part by means of a spring mechanism so that the pad is spring mounted and may be moved to a raised position to allow easy entrance and exit from the machine. A cam fixed to the movement arm is connected to the weight stack pin by means of an actuating lever located below the weight stack. The movement arm is also provided with a counterweight for balancing the movement arm about its horizontal pivot axis.

24 Claims, 7 Drawing Sheets

ABDOMINAL EXERCISE MACHINE AND METHODS

BACKGROUND OF INVENTION

The present invention generally relates to methods and apparatus for exercising the abdominal muscles.

In the past there have been quite a variety of exercise apparatus available for exercising the abdominal muscles. One such apparatus includes an adjustable slant board with a pad for holding a user's feet in place while sit-ups are performed. Also available are machines in which a user sits and which have a movement arm connected to a weight stack. By moving a movement arm in a forward and downward direction against the resistance of the weight stack, a user can exercise the abdominal muscles. Another abdominal exercise apparatus rests on the floor and supports the upper half of a user's body while in a reclined position on the floor. These devices also have arm, head and neck pads for supporting a user's arms, head and neck respectively, and curved rocker components in contact with the floor. To exercise the abdominal muscles, the user does regular sit-ups aided by the fact that the apparatus rocks back and forth while providing head, neck and back support for the duration of the exercise.

Though the above apparatus are capable of exercising a user's abdominal muscles they do have certain drawbacks. The padded slant board device can cause severe neck and lower back pain. The weight stack apparatus in which the user sits can be uncomfortable to enter and exit and also uses over-head cables in the transmission mechanism which introduce unnecessary friction and wear in the system. The rocking apparatus in some cases does not allow a full range of exercise motion and the exercise can be inefficient.

A further and serious drawback of all of the prior-art devices mentioned above is that they fail to isolate the abdominal muscles of a user during the exercise. As a result, the user is not efficiently exercising the abdominal muscles, but rather he/she is also straining or exercising some other muscle group in the body. This condition lessens the overall quality of the user's workout, and can also lead to misleading results when recording one's abdominal muscle conditioning progress. Furthermore, failure to isolate the abdominal muscles also can cause lower back pain because the hip flexors are free to rotate the pelvis during the exercise. The hip flexors are attached at the base of the spine. When they are overworked, they become sore or inflamed causing lower back pain.

In summary the above-mentioned apparatus of the prior art can not only cause lower back pain they can also lessen the quality of the exercise.

OBJECTS OF INVENTION

The present invention seeks to overcome the above noted deficiencies of prior-art, abdominal exercise machines and methods while also providing other improvements to abdominal exercise machines and methods. It is therefore an object of the present invention to provide novel and improved methods and apparatus for exercising the abdominal muscles of the human body. Included herein are such apparatus which are "user friendly" in facilitating access to or exit from the apparatus, selection of resistance weights and range of exercise movement, and positioning of the user relative to a movement arm.

A further and very important object of the present invention is to provide a novel method and apparatus for isolating the abdominal muscles while they are being exercised.

Still another object of the present invention is to provide a novel method and apparatus for exercising the abdominal muscles in a safe and easy manner. Included herein are such methods and apparatus that secure the user in the apparatus to enhance stability and comfort.

Another object of the present invention is to provide a novel method and apparatus for exercising the abdominal muscles capable of producing consistent and reliable results which can also be used to accurately record the progress or strength of the abdominal muscles.

SUMMARY OF THE PRESENT INVENTION

In accordance with the present invention, an abdominal exercise method and apparatus is provided wherein the abdominal muscles are isolated from the hip flexors during forward and rearward movement of the torso through use of the abdominal muscles. In the preferred embodiment of the invention, such isolation is achieved by holding the legs of the exerciser in a spread apart position thereby eliminating the hip flexors from the exercise. It is preferred that the exercise be carried out against a resistance provided by a movement arm engagable by the front of the torso in the chest area, the movement arm being connected to a resistance, preferably a weight stack.

One preferred apparatus of the invention includes a seat for the exerciser and a pair of movable isolation members, preferably pads, intended for movement between a closed position and one or more spread apart positions where they engage the inner sides of the legs in the thigh area and maintain the legs in a spread apart position with the exerciser seated. The preferred apparatus also includes a two piece movement arm allowing easy entrance to and exit from the apparatus. Other features of the present invention are described below.

DRAWINGS

Other objectives and advantages of the present invention will become apparent from the following more detailed description of the present invention taken in conjunction with the attached drawings in which.

DETAILED DESCRIPTION

Figure 1:
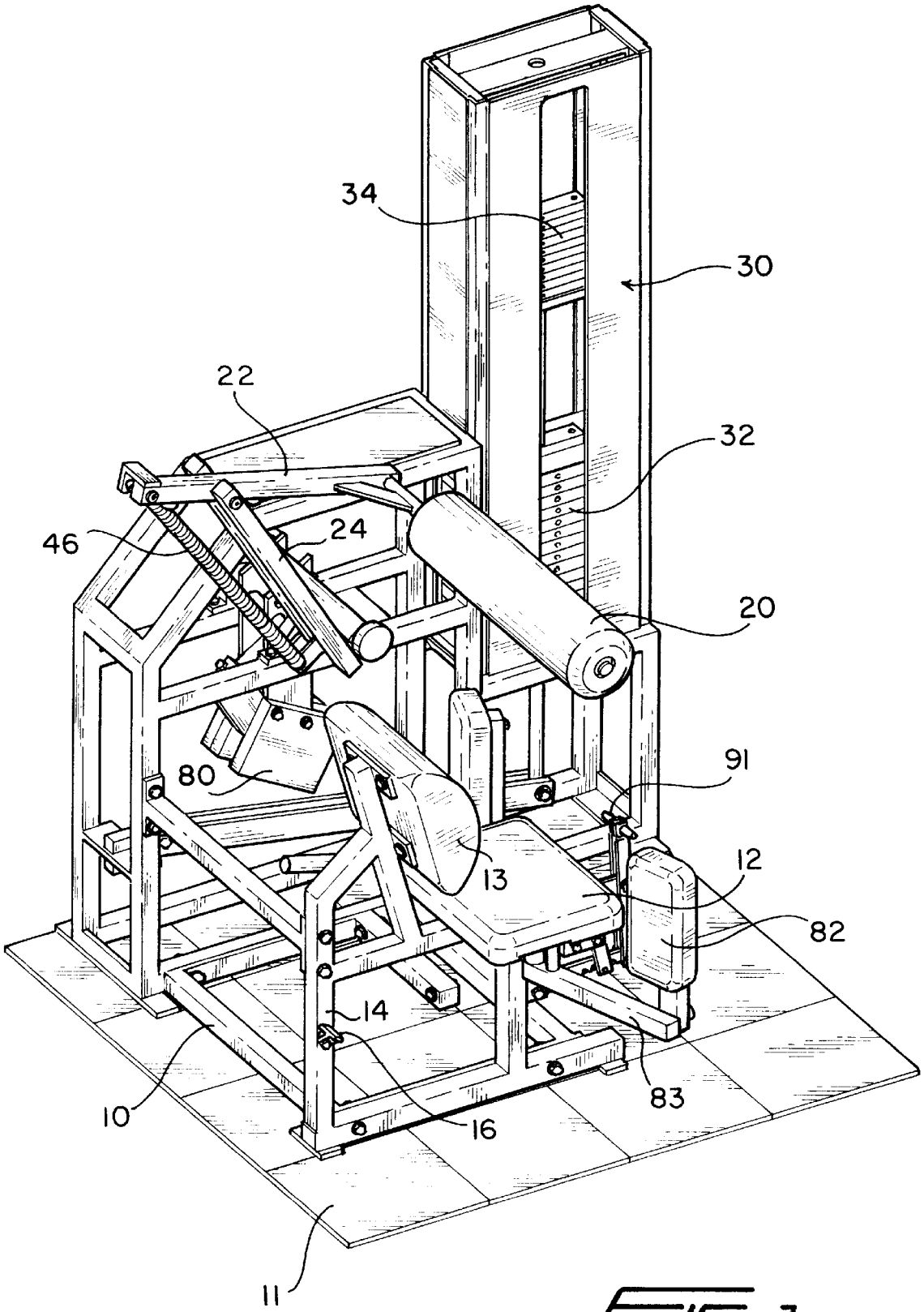
FIG. 1 is a perspective view of an abdominal exercise machine or apparatus constituting a preferred embodiment of the present invention.

Referring now to the drawings in detail there is shown for illustration purposes only a machine or apparatus constituting a preferred embodiment of the present invention for carrying out the method of the present invention. The machine includes a frame generally designated 10 for placement on a floor 11 as shown in FIG. 1, including elongated structural metallic members. Supported on the frame is a seat 12 and a backrest 13 for holding an exerciser in the seated position as the exerciser moves his torso forwardly and backwardly against a movement arm including a resistance pad 20 by exercising the abdominal muscles. The exercise is performed against the opposition of a resistance preferably a weight stack generally designated 30 including lower and upper weight stacks 32 and 34 which may be connected to the movement arm together or independently of each other. For a more detailed description of such a compound weight stack, reference may be had to U.S. Pat. No. 4,834,365 whose disclosure is hereby incorporated by reference into the subject application as part hereof.

Figure 2:
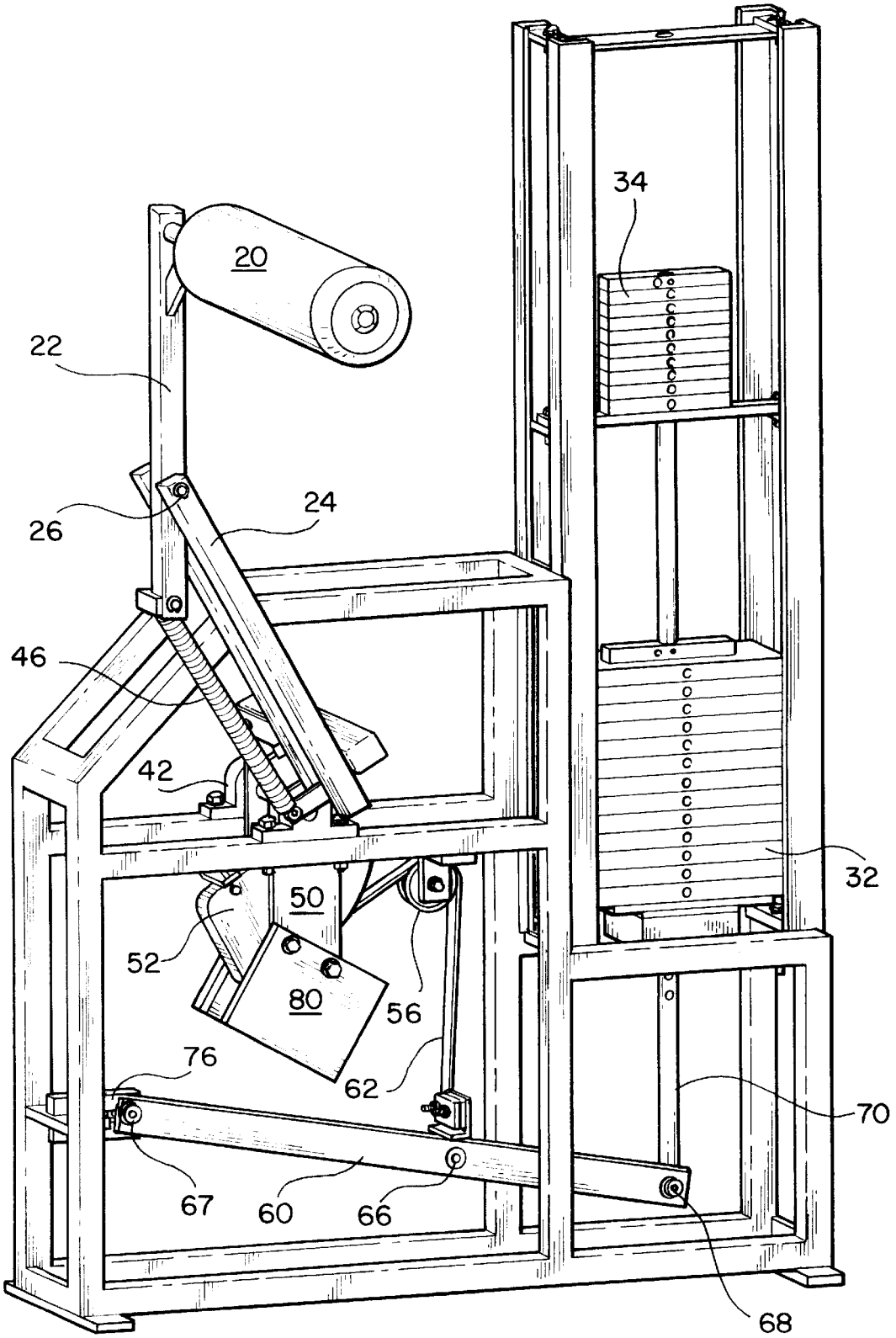
FIG. 2 is a perspective view of the machine with parts removed and with a movement arm shown in an upper position providing easy entry to or exit from the machine.
Figure 3:
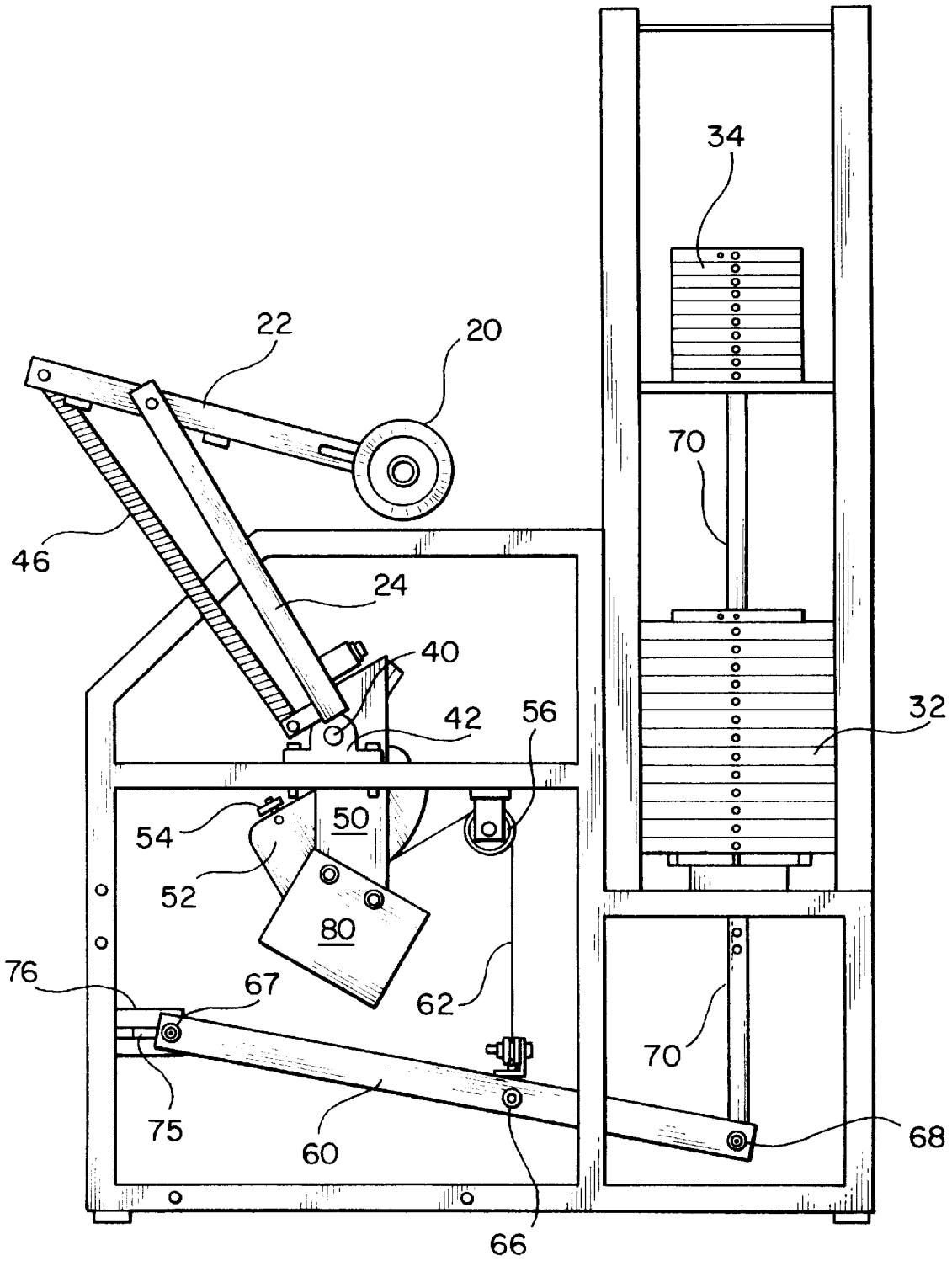
FIG. 3 is a side elevation view of the machine showing the movement arm in a "start" position and with parts of the machine removed for clarity.
Figure 4:
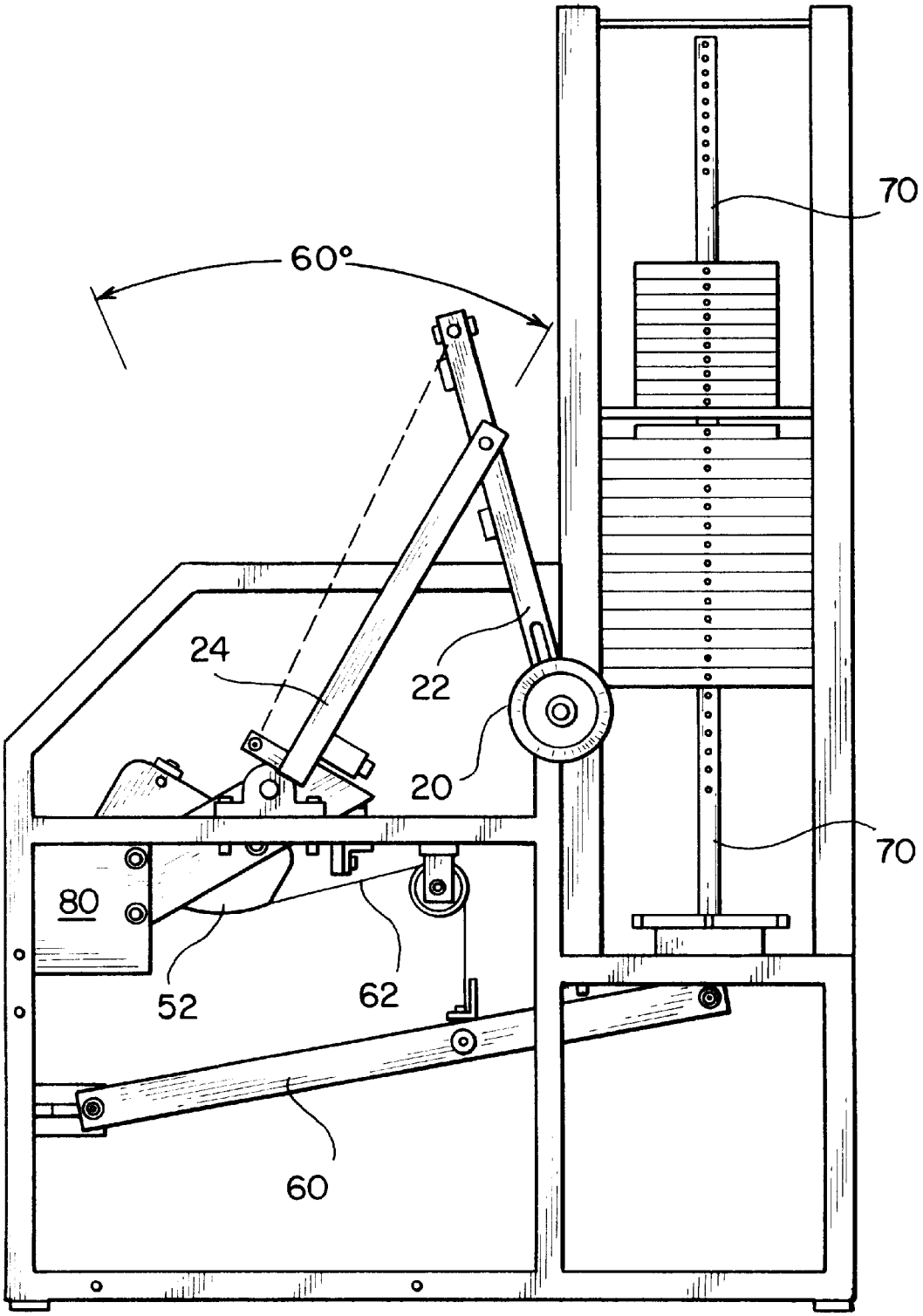
FIG. 4 is a view generally similar to FIG. 3 but with the movement arm shown in a "finish" position.

In accordance with a feature of the present invention, a movement arm is constructed in two relatively movable pieces including an upper member 22 and a lower member 24 pivotally interconnected at 26 for movement between a first position shown in FIG. 2 where the pad 20 is in an uppermost or raised position allowing entrance to or exit from the machine, and a lower position such as shown in FIG. 3 which is the position of the pad and movement arm at the start of an exercise as described further below; and a lowermost position shown in FIG. 4 achieved by the exerciser upon forward and downward movement of the upper torso. In the preferred embodiment, upper movement arm 22 is biased towards a raised position by means of an elongated tension spring 46 having one end connected to the end of upper member 22 opposite the pad 20 and another end connected to a lower end portion of lower movement arm 24. At the start of an exercise, pad 20 is positioned as shown in FIG. 3 where it engages the front of the exerciser at the chest or shoulder area. To perform the exercise, the exerciser bends his/her torso forwardly by exerting their abdominal muscles which causes the pad 20 to move forwardly and downwardly along an arc with an extreme forward position shown in FIG. 4 spaced approximately sixty degrees from the starting position. This movement of course is effected against the opposition of the weight stack one or more weights of which is raised by positive work performed by the exerciser after which the exerciser returns to the starting position during which the weight is lowered by the performance of negative work by the exerciser. The exercise is repeated as desired.

In the preferred embodiment shown, transmission of movement between the movement arm 22,24 and the weight stack is effected through a cam 52 fixed to the movement arm by means of mounting members 50 to which are fixed the cam 52 and the lower movement arm member 24. Mounting member 50 is pivoted for movement about a shaft 40 mounted in bearing blocks 42 to provide a generally horizontal pivot axis 40 for the movement arm during the exercise. Referring to FIG. 3, a cable, belt or strap 62 is fixed at 54 to the perimeter of cam 52 at one end while the other end is connected at 66 to an actuating lever 60 located below the cam and the weight stack. The intermediate portion of strap 62 is trained about a pulley 56 suitably mounted to a frame portion of the machine. The rear-end portion of actuating lever 60 is pivotally mounted in a slot 75 for pivotal and slidable movement relative to the frame of the machine, the slot 75 being formed in a bracket 76 fixed to the frame. The forward portion of actuating lever 60 is pivotally connected at 68 to the bottom end of the weight stack pin 70. It will therefore be seen that when the movement arm is moved forwardly or clockwise from the position shown in FIG. 3, cam 52 will rotate with the movement arm to raise strap 62 and in turn the actuating lever 60 which will pivot at 67 and also be free to rectilinearly move in slot 75. As shown in FIG. 4, the forward end of actuating lever 60 will therefore raise stack pin 70 and any of the weights which are attached to the stack pin 70. When the exerciser returns to the starting position, the stack pin 70 will be lowered by gravity thereby returning the lever 60 and cam 52 to the position shown in FIG. 3.

In order to balance the movement arm about its pivot axis 40, one or more counter weights 80 are fixed to mounting member 50 on opposite sides of the cam 52 in the specific embodiment shown. In this way, the weight of the movement arm 22,24 does not enter into the exercise to aid the exerciser or alter the selected weight resistance.

Figure 5:
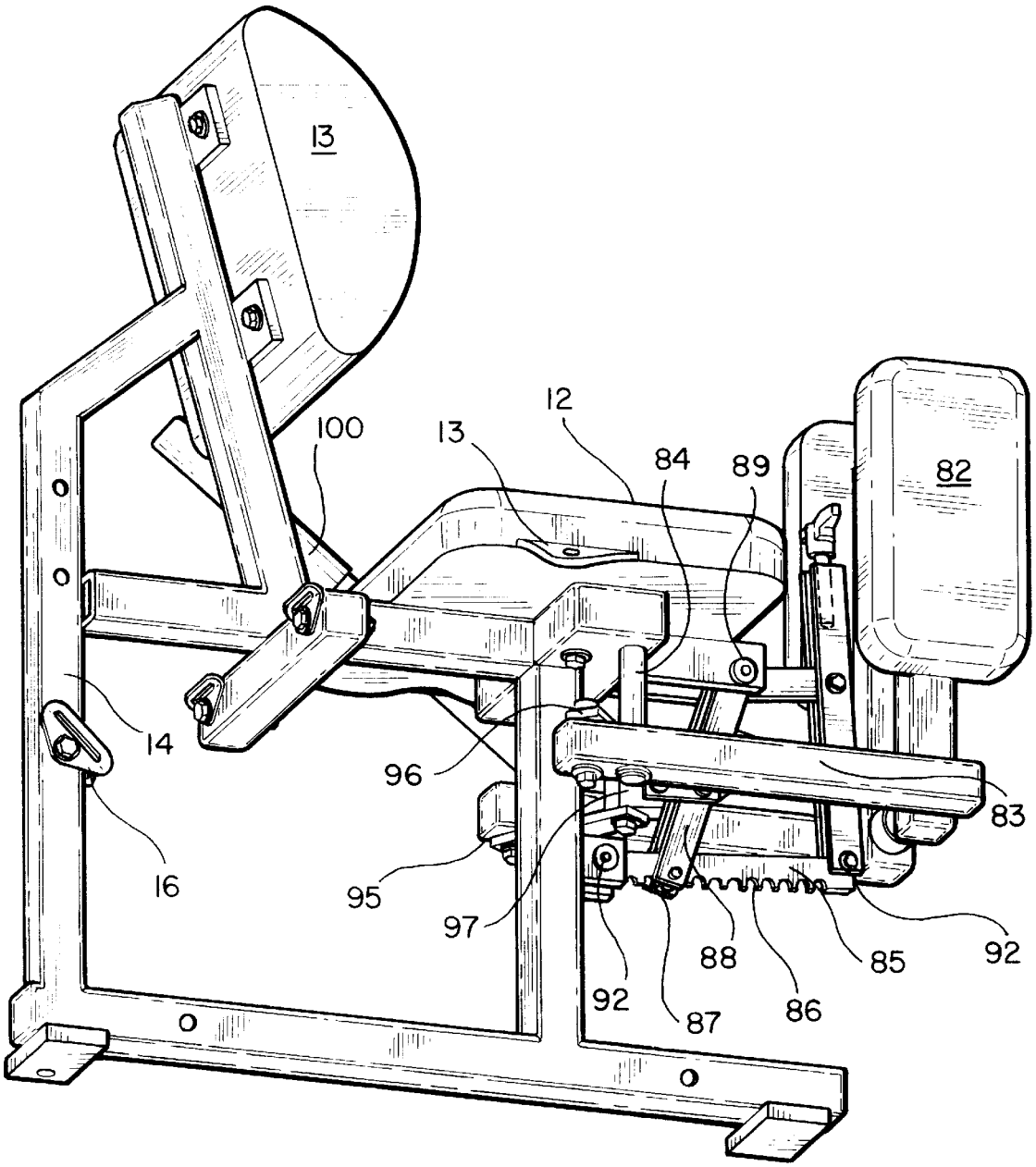
FIG. 5 is a perspective view of a portion of the machine showing a seat, thigh pads in a closed position and a latch mechanism all included in the machine.
Figure 6:
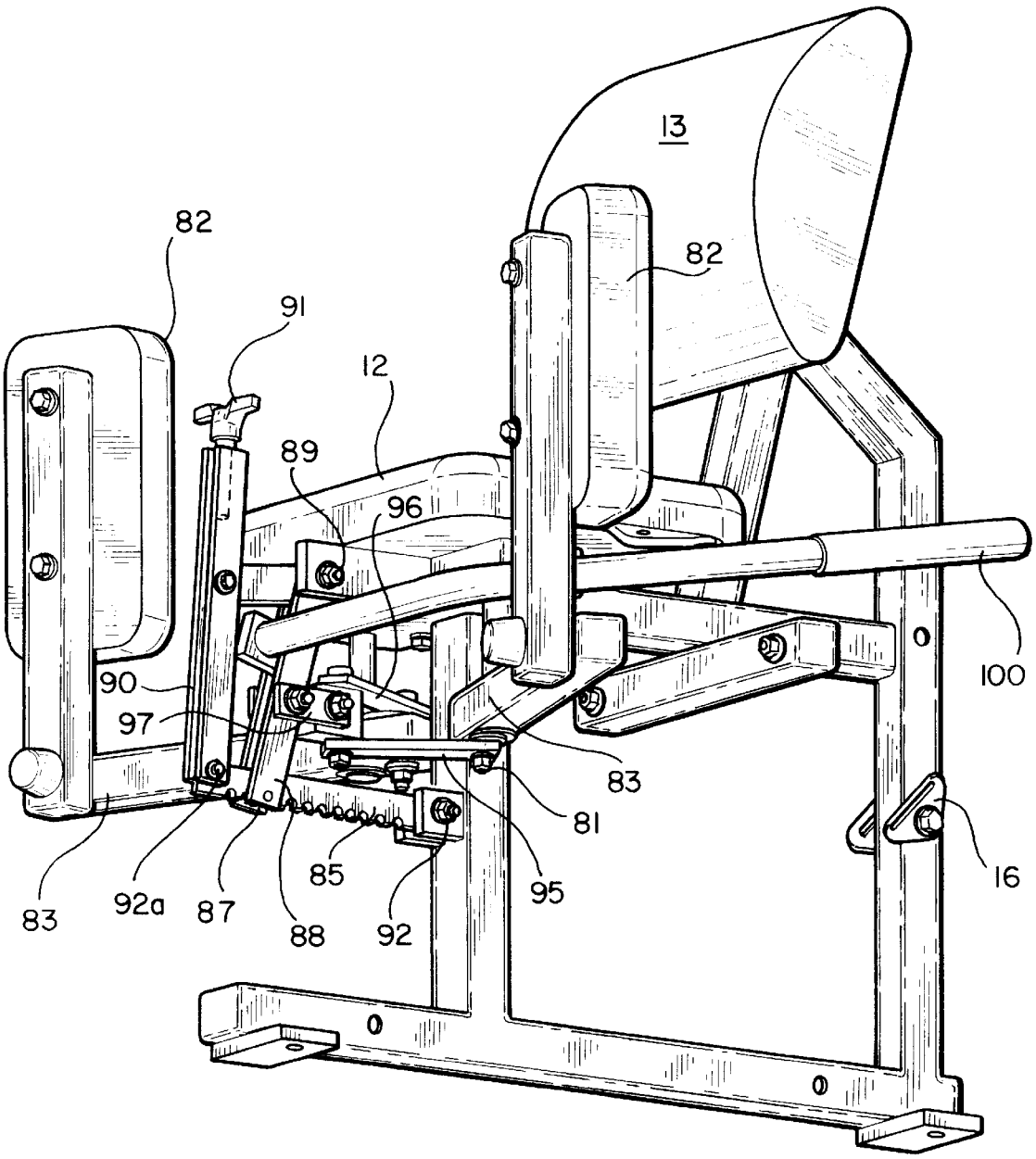
FIG. 6 is a perspective view of the parts shown in FIG. 5 but as seen from the opposite side thereof.
Figure 7:
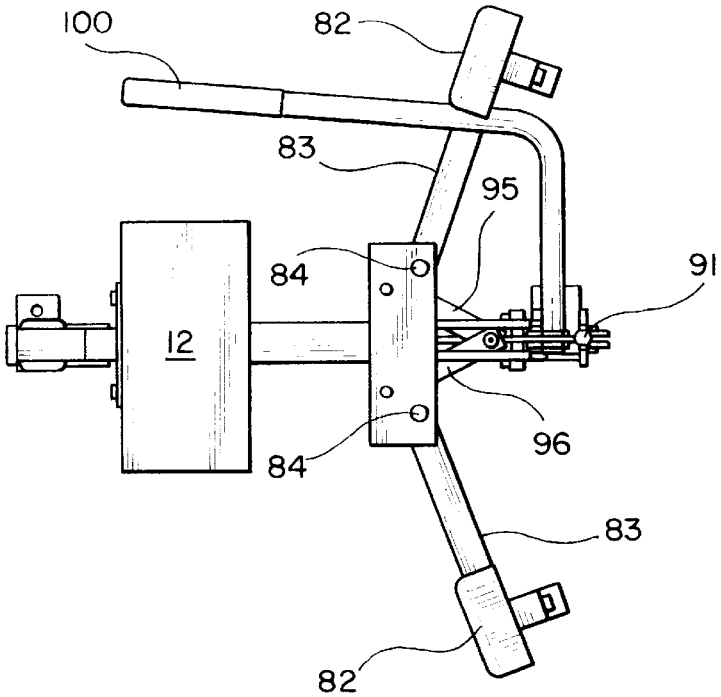
FIG. 7 is a plan view to a reduced scale of portions of the machine.
Figure 8:
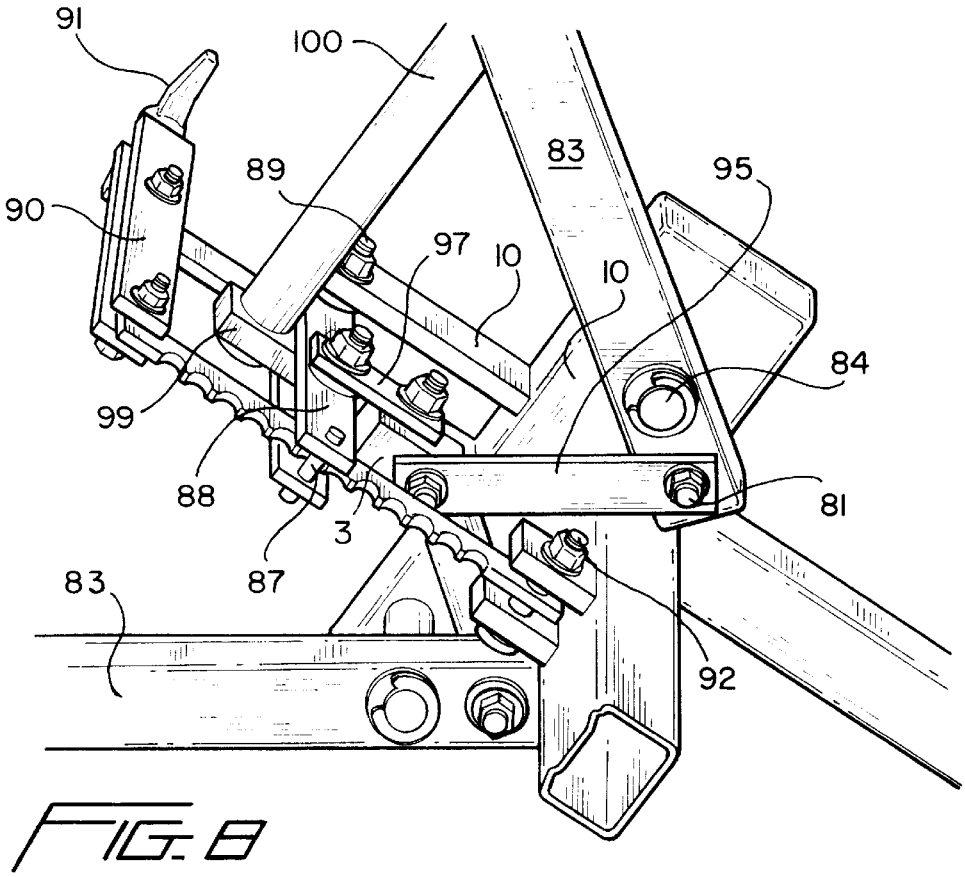
FIG. 8 is a perspective view to a reduced scale of portions of the machine showing a motion transmission and latch mechanism included in the machine.

In accordance with an important feature of the present invention, the exerciser's legs are held in a spread apart position during the performance of the exercise so as to isolate the abdominal muscles from the hip flexors so that the hip flexors will not become involved in the exercise. In the preferred embodiment shown, the foregoing isolation is accomplished with the use of a pair of pads 82 movable between a closed position shown in FIG. 5 and various spread apart positions depending on the size of the exerciser, one such spread apart position being shown in FIG. 1. Pads 82 may be mounted to the frame of the machine in any suitable manner including, for example, generally horizontally extending arms 83 fixed at one end to the pads 82 and at the other end pivotally mounted to the frame by means of pivot pins 84, one being shown in FIG. 5. From the closed position shown in FIG. 5, the pads 82 are moved laterally outwardly by means, in the shown embodiment, of a hand lever 100 operatively connected to mounting arms 83 by a linkage including links 95,96 such that when the lever 100 is lowered, the pads will move apart from each other. Referring to FIGS. 5,6 and 8 in order to return the pads 82 to their closed position shown in FIG. 5, the exerciser merely applies pressure to the pads through his legs at the thighs by moving his legs inwardly from their spread apart position.

In order to lock the pads 82 in a desired spread apart position, a latch mechanism is provided in the shown embodiment including latch 85 having a series of recesses 86 in one edge thereof for receiving a lock pin 87. The rear end of latch 85 is pivotally mounted at 92 to the frame while the forward end is connected at 92 to a release 90 having a handle 91 for pulling the release 90 upwardly to disengage the latch 85 from a locking pin 87. The latter is held in a link 88 pivotally mounted at 89 to the frame 10. In the specific embodiment shown hand lever 100 is fixed to a small flange 99 which in turn is fixed to link 88. A short link 97 interconnects link 88 and a block 3 the opposite, upper and lower sides of which are pivotally connected to links 95 and 96 which in turn are pivotally connected to arms 83 at pivots 81. When the lever 100 is lowered, the link 88 will pivot about pivot 89 forwardly as viewed in FIG. 6 which will cause the latch pin 87 to ratchet forwardly along recesses 86 in latch 85. At the same time short link 97 will be pulled forwardly by link 88 thus actuating links 95,96 and the associated arms 83 to open or spread apart positions. FIG. 8 shows an intermediate open position of the leg pads 82. In order to close the leg pads 82, the handle 91 of release 90 is pulled upwardly to release latch 85 from latch pin 87. When the latch 85 is released, handle 100 may be appropriately moved to adjust the spread apart position of the leg pads 82 to suit the size of a specific user of the machine.

To review operation of the machine in accordance with the present invention, the lower movement arm 24 is moved rearwardly to the position shown in FIG. 2 and the upper movement arm member 21 is pivoted upwardly relative to the lower member 24 into the position shown in FIG. 2. The exerciser then enters the machine and is seated on seat 12. If desired, one or more straps (not shown) may be fastened about the exerciser to secure the exerciser's position during the exercise. The straps are connected to plates 16 on upright 14 in the shown embodiment, see FIG. 5 and 6. The exerciser then spreads the legs apart as far as possible and then lowers lever 100 to move pads 82 outwardly to engage the spread apart legs at the thighs and to hold them in that position. The upper movement arm 22 is lowered from the position shown in FIG. 2 to the start position shown in FIG. 3 where pad 20 extends across the upper chest of the exerciser at the shoulders. The exerciser then proceeds to move the movement pad 20 forwardly and downwardly towards the position shown in FIG. 4 as the movement arm pivots about the horizontal axis 40 in opposition to the weight stack one or more weights of which are lifted by the exerciser as the abdominal muscles are exerted. When the exerciser reaches the limit of forward movement, he returns slowly and gradually to the starting position and repeats the exercise. It is preferred that a resistance weight be chosen such that it is less than the maximum strength of the exerciser's abdominal muscles so that no great strain is involved when moving the resistance pad 20. The above exercise is repeated and when the exercise is concluded the exerciser grasps the release handle 91 pulling the latch member 85 upwardly to release the latch pin 87 from the latch 85 allowing the exerciser to exert with the thighs pressure on the pads 82 to return them to the start position shown in FIG. 5. The movement arm on pad 20 may then be raised to the position shown in FIG. 2 to allow easy exit from the machine.

It will be seen from the above that the isolation of the abdominal muscles from the hip flexors allows the abdominal muscles to be exercised with greater efficiency than that available with prior art machines and methods. Moreover, the positioning of the legs in the spread apart position prevents the hip flexors and in turn the pelvis from moving during the exercise thereby preventing inflamation and pain of the hip flexors and the lower spine during the exercise. The present invention therefore minimizes if not eliminates lower back pain which has been typically associated with abdominal exercise.

Although a preferred embodiment of the present invention has been shown and described above, it will be understood by those of ordinary skill in the art that the present invention is not to be limited to the specific embodiment shown but rather the scope of the invention is defined in the appended claims.

What is claimed is:

1. A machine for exercising abdominal muscles of the human body comprising in combination, a movement arm moveable about an axis upon engagement with the body, a resistance connectable to the movement arm to oppose movement of the movement arm about said axis in one direction, and drive transmission means between said resistance and said movement arm for transmitting movement therebetween, and wherein said movement arm includes two members pivotally interconnected, and spring means biasing one of the members to a raised position relative to the other member to allow entry and exit of a user into and from the machine, said one member being located to be engageable by the upper front of the torso of the user for movement in a vertical plane between a start position and a finish position advanced forwardly of the user and downwardly, the other member being moveable between said start and finish positions about a generally horizontal axis.

2. The machine defined in claim 1 wherein said movement arm members are movable relative to each other in a vertical plane between first and second positions allowing entry and exit by a user of the machine.

3. The machine defined in claim 1 wherein said spring means includes a tension spring connected to said members.

4. The machine defined in claim 1 wherein said one of the members is movable in a vertical plane and has a horizontal pad engageable across the upper front portion of the torso of the user's body.

5. The machine defined in claim 1 including a counterbalance mechanism attached to the movement arm to counterbalance the movement arm about said generally horizontal axis.

6. The machine defined in claim 1 further including a seat for receiving a user and means for spreading and holding the legs of a user in a position with the legs spread apart at least forty-five degrees (45°) while the user performs an exercise.

7. The machine defined in claim 6 with said leg holding means including two pads mounted on the frame of the machine for engaging the inner portions of the thighs of a user of the machine.

8. The machine defined in claim 7 wherein said resistance includes a weight, and said transmission means includes a lever below the weight and connected to the movement arm.

9. The machine defined in claim 1 wherein said transmission means includes a cam operatively connected to said movement arm.

10. The apparatus defined in claim 1 wherein said one member is moveable back and forth in an arc-like motion in a vertical plane from said start position to said finish position of about 60° from said start position.

11. Apparatus for exercising the abdominal muscles comprising in combination, a movement arm movable about an axis in response to engagement by the torso of a user of the apparatus, resistance means operatively connected to the movement arm to resist movement of the movement arm about said axis, drive transmission means between said resistance means and said movement arm for transmitting movement therebetween, and means for holding the user's legs in a spread apart position as the user moves the movement arm forwardly with his torso from a first position to a second position and then moves his torso backwards returning the movement arm to the first position, said means for holding the user's legs in a spread apart position including two pads mounted on a frame of the apparatus for respectively engaging inner portions of the user's legs and means for adjusting said pads inwardly or outwardly including linkage means operatively connecting said pads with an adjusting handle.

12. The apparatus defined in claim 11 wherein said movement arm includes two members pivotally interconnected, and spring means biasing one of the members relative to the other member.

13. The apparatus defined in claim 12 wherein said resistance means includes a weight, and said transmission means includes a lever below the weight and connected to the movement arm, and a cam operatively connected to said lever and the movement arm.

14. The apparatus defined in claim 11 where said pads are angularly adjustable in a generally horizontal plane through an angle greater than 45°.

15. The apparatus defined in claim 11 further including lock means for locking said pads in adjusted position including a handle for operating said lock means.

16. The apparatus defined in claim 15 further including lock releasing means capable of unlocking said pads for movement, and including a handle for operating said lock releasing means.

17. The apparatus defined in claim 16 with said lock means including a lock member having spaced apart recesses for receiving a locking pin, said lock member being movable by said handle.

18. The apparatus defined in claim 17 with said lock releasing means including a link connected to said recessed lock member, and a handle member for separating said locking pin from the lock member.

19. The apparatus defined in claim 11 where said pad adjustment means includes a movable adjustment lever engageable by the hand, said drive transmission means including links pivotable about generally vertical axes, and said adjustment lever being connected to said links and movable about a generally horizontal axis.

20. The apparatus defined in claim 11 wherein said means for adjusting said pads includes a first linkage connected to said pads, a second linkage connected to said first linkage, and a lever fixed to said second linkage to actuate the same and wherein said second linkage includes a recessed locking member for locking the second linkage in adjusted position and a handle for operating said recessed locking member.

21. The machine defined in claim 11 wherein said transmission means further includes a cam connected to the movement arm.

22. A machine for exercising abdominal muscles of the human body comprising in combination, a movement arm movable about an axis upon engagement with the body, a resistance connectable to the movement arm to oppose movement of the movement arm about said axis in one direction, and a drive transmission means between said resistance and said movement arm for transmitting movement therebetween, and wherein said movement arm includes two members pivotally interconnected, and spring means biasing one of the members relative to the other member, and wherein there is further included a seat for receiving a user and leg holding means for holding the legs of a user in a spread apart position while the user performs an exercise, said leg holding means including two pads mounted on the frame of the machine for respectively engaging the inner portions of the thighs of a user of the machine, and wherein said resistance includes a weight, and said transmission means includes a lever below the weight connected to the movement arm.

23. Apparatus for exercising the abdominal muscles comprising in combination, a movement arm moveable about an axis in response to engagement by the torso of a user of the apparatus, resistance means operatively connected to the movement arm to resist movement of the movement arm about said axis, drive transmission means between said resistance means and said movement arm for transmitting movement therebetween, and means for holding the user's legs in a spread apart position as the user moves the movement arm forwards with his torso from a first position to a second position and then moves his torso backwards returning the movement arm to the first position, said means for holding the user's legs in a spread apart position including two pads mounted on the frame of the machine for engaging inner portions of the user's legs, means for adjusting said pads inwardly or outwardly, lock means for locking said pads in adjusted position, lock releasing means capable of unlocking said pads for movement, said locking means including a lock member having spaced apart recesses for receiving a locking pin, a link connected to said recessed lock member, and a handle for separating said locking pin and lock member.

24. A machine for exercising abdominal muscles of the human body comprising in combination a movement arm moveable about an axis upon engagement with the body, said movement arm including two members pivotally interconnected, and spring means biasing one of the members relative to the other member, a resistance including a weight connectable to the movement arm to oppose movement of the movement arm about said axis in one direction, and drive transmission means between said resistance and said movement arm for transmitting movement therebetween, said drive transmission means including a lever below the weight and connected to the movement arm.

* * * * *